US007107784B2

(12) United States Patent
Beck

(10) Patent No.: US 7,107,784 B2
(45) Date of Patent: Sep. 19, 2006

(54) THERMAL MANAGEMENT SYSTEM USING AN ABSORPTION HEAT PUMP

(76) Inventor: Douglas S. Beck, 3319 21st Ave. NW., Gig Harbor, WA (US) 98335

( * ) Notice: Subject to any disclaimer, the term of this patent is extended or adjusted under 35 U.S.C. 154(b) by 132 days.

(21) Appl. No.: 10/935,951

(22) Filed: Sep. 8, 2004

(65) Prior Publication Data

US 2006/0048536 A1 Mar. 9, 2006

(51) Int. Cl.
*F25B 13/00* (2006.01)
*F25B 15/00* (2006.01)

(52) U.S. Cl. ..... 62/324.2; 62/476

(58) Field of Classification Search ..... 62/118, 62/324.1, 324.2, 476, 478, 483
See application file for complete search history.

(56) References Cited

U.S. PATENT DOCUMENTS 4,205,532 A * 6/1980 Brenan ..... 62/115
5,069,038 A * 12/1991 Peinze ..... 62/636

* cited by examiner

*Primary Examiner*—Melvin Jones
(74) *Attorney, Agent, or Firm*—Jensen & Puntigam P.S.

(57) ABSTRACT

The thermal management system includes: one or more heat acceptors which remove heat from one or more warm temperature heat sources; one or more absorption heat pumps, which use the heat removed from the warm temperature heat sources to generate either refrigeration or heating; a transfer system, such as a generator pumped liquid loop, for moving heat from the warm temperature heat sources to the absorption heat pumps; a transfer system, such as an absorber pumped liquid loop, for directing heat from the absorption heat pumps to one or more heat sink(s) at one or more temperatures if the absorption heat pumps are generating refrigeration; a transfer system, such as an evaporator pumped liquid loop, for directing heat from one or more cool temperature heat sources, at one or more temperatures, to the absorption heat pump(s) if the absorption heat pump(s) are operating generating heating; a transfer system, such as an evaporator pumped liquid loop, for directing heat from one or more cooling loads to the absorption heat pumps if the absorption heat pumps are generating refrigeration; and a transfer system, such as an absorber pumped liquid loop, for directing heat from the absorption heat pumps to one or more heating loads if the absorption heat pumps are generating heating.

19 Claims, 3 Drawing Sheets

THERMAL MANAGEMENT SYSTEM USING AN ABSORPTION HEAT PUMP

TECHNICAL FIELD

This invention relates generally to thermal management systems, and more specifically concerns a thermal management system which includes an absorption heat pump.

BACKGROUND OF THE INVENTION

A thermal management system removes unwanted heat from one (or more) warm-temperature heat source(s), and rejects, i.e. directs, the heat to one (or more) heat sink(s). Thermal management systems are critical components of larger systems that, for example, generate large amounts of unwanted heat and/or generate unwanted heat with a high heat flux (heat flux is defined as heat flow per unit of area, which can be expressed in the units of Watts/($cm^2$).

There are many specific examples of critically needed thermal management systems for use on various navy ships, particularly warships. Future warships will include advancements in power electronics that enable technologies such as the integrated power system (IPS), electromagnetic weapons (EMW), high power radar, and others. The solid state power conversion inherent in the new technologies produces heat loads in excess of those in today's shipboard electrical systems. As these technologies become fully implemented, the population of solid state power conversion devices will increase, and, because warships typically have limited space, the power density of the devices and the heat fluxes of the generated heat will experience a comparable increase. The heat fluxes of the generated heat in the devices will eventually surpass 1,000 W/$cm^2$, but existing technologies are limited to cooling heat fluxes of only approximately 100 W/$cm^2$.

Heat acceptors (for example, heat acceptors that use jet impingement or droplet impingement) are being developed to remove high heat fluxes (up to 1,100 W/$cm^2$ or more), but the thermal management systems that contain the heat acceptors waste the removed heat by rejecting the heat directly to heat sink(s). Cooling or heating is often needed in close proximity to the sources of high heat flux. Space cooling of compartments that will contain high-heat-flux power electronics will be required. Thermal management systems will remove heat from the high-heat-flux power electronics and reject the removed heat to a fresh water cooling loop; however, thermal management systems for many other components in the compartments will reject heat to the compartment air. Therefore, cooling will be needed to remove heat from the compartment air and prevent excessively hot air temperatures in the compartments.

An absorption heat pump accepts heat from one (or more) warm temperature heat sources(s) and generates either refrigeration or heating. When an absorption heat pump generates refrigeration, it absorbs heat from a cooling load and rejects heat to a heat sink. When an absorption heat pump generates heating, it absorbs heat from a cool temperature heat source and rejects heat to a heating load. Many alternative systems are capable of using heat from a warm temperature heat source to produce refrigeration or heating. However, for a given amount of heat input from warm temperature heat source(s), absorption heat pumps can produce more refrigeration or heating than the alternative systems if the difference between the temperature(s) of the warm-temperature heat source(s) of the heat sink(s) or the cool-temperature heat source(s) is small.

Therefore, a need exists for a thermal management system that uses one or more absorption heat pump(s) to provide either refrigeration or heating.

SUMMARY OF THE INVENTION

Accordingly, the present invention is a thermal management system for generating refrigeration or heating, comprising: one or more heat acceptors, which remove heat from one or more warm-temperature heat sources; one or more absorption heat pumps which use heat removed from the warm-temperature heat sources to generate refrigeration or heating; a transfer system for directing heat from the warm-temperature heat sources to the absorption heat pumps; a transfer system for directing heat from the absorption heat pumps to one or more heat sinks if the absorption heat pumps are generating refrigeration; a transfer system for directing heat from one or more cool-temperature heat sources to the absorption heat pumps if the absorption heat pumps are generating heating; a transfer system for directing heat from one or more cooling loads to the absorption heat pumps if the absorption heat pumps are generating refrigeration; and a means for transferring heat from the absorption heat pumps to one or more heating loads if the absorption heat pumps are generating heating.

BEST MODE FOR CARRYING OUT THE INVENTION

Figure 1:
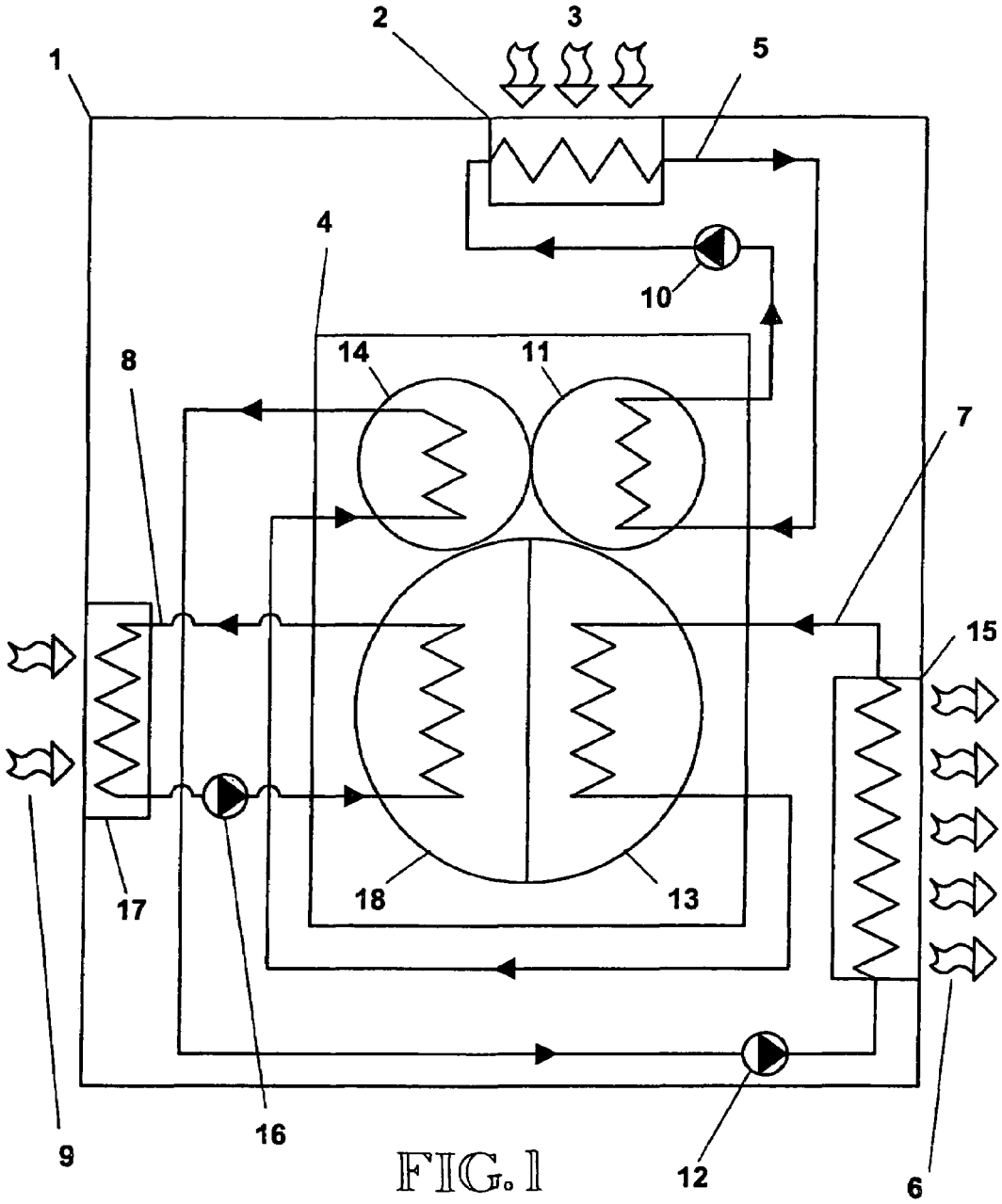
FIG. 1 shows one embodiment of the invention, a modular thermal management system that includes a single heat acceptor and a single absorption heat pump, which is generating refrigeration.

FIG. 1 shows one embodiment of the invention, a modular thermal management system 1 for generating refrigeration that includes a single heat acceptor 2 and a single absorption heat pump 4, which is generating refrigeration. An example of the type of refrigeration the absorption heat pump 4 could be generating is chilling a liquid, such as water or an ethylene-glycol solution. The modular thermal management system 1 includes:

one heat acceptor 2, which removes heat from one warm temperature heat source 3; and one absorption heat pump 4, which uses the heat removed from the warm temperature heat source 3, such as Navy shipboard power electronics, to generate refrigeration;

a generator pumped liquid loop 5, which transfers heat from the warm temperature heat source 3 to the absorption heat pump 4 by using a generator pump 10 to pump a liquid first through the heat acceptor 2, where the liquid absorbs heat, and then through the generator 11 of the absorption heat pump 4, where the liquid releases the heat;

an absorber pumped liquid loop 7, which transfers heat from the absorption heat pump 4 to a heat sink 6 by using an absorber pump 12 to pump a liquid first through the absorber 13 of the absorption heat pump 4, where the liquid absorbs heat, then through the condenser 14 of the absorption heat pump 4, where the liquid absorbs additional heat, and then through the heat sink exchanger 15, where the liquid releases the heat to the heat sink 6; and an evaporator pumped liquid loop 8, which absorbs heat from a cooling load 9, such as the compartment in which power electronics are mounted on Navy ships, and transfers the heat to the absorption heat pump 4 by using an evaporator pump 16 to pump a liquid first through the load heat exchanger 17, where the liquid absorbs heat from the cooling load 9, and then through the evaporator 18 of the absorption heat pump 4, where the liquid releases the heat to the Evaporator 18.

Figure 2:
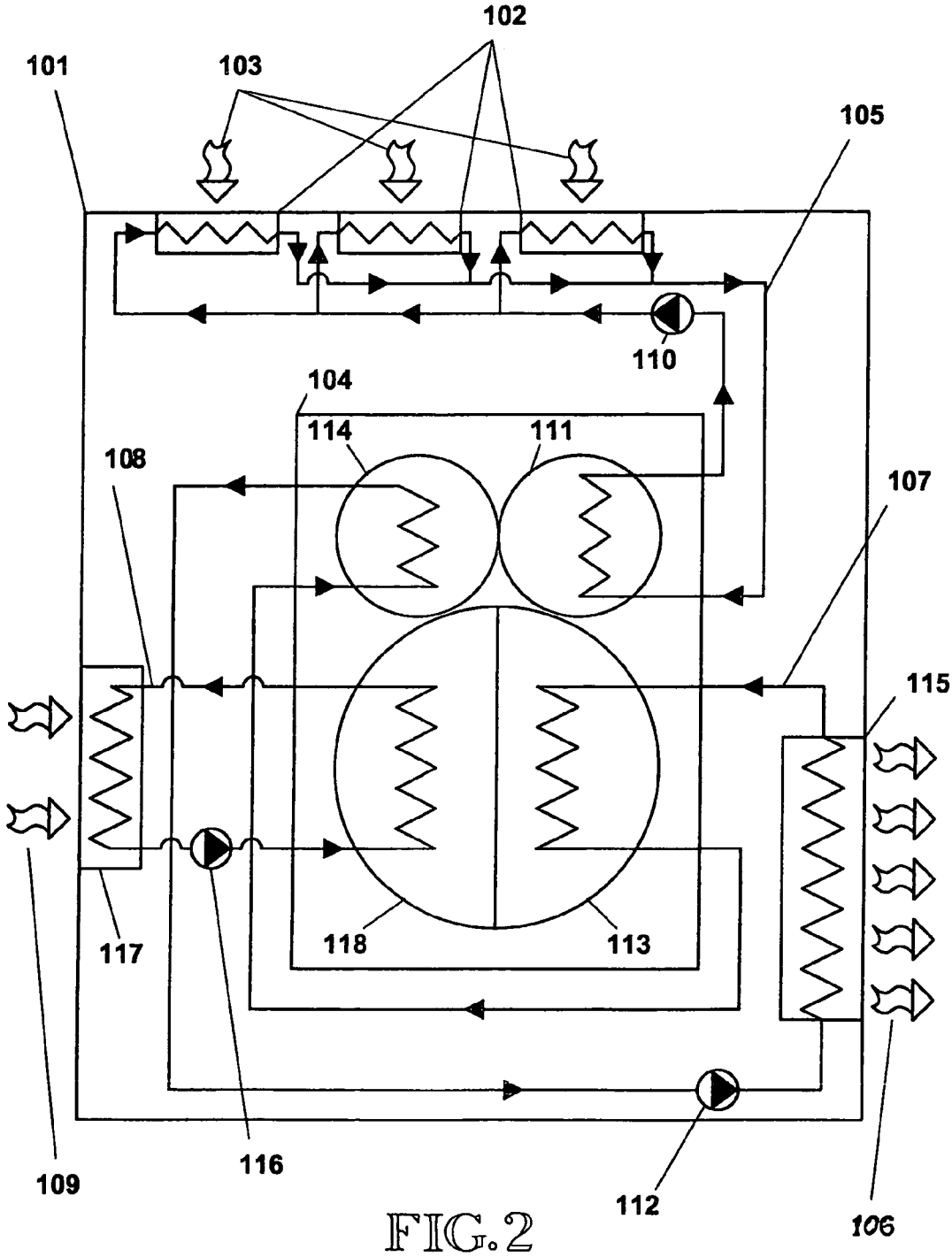
FIG. 2 shows one embodiment of the invention, a centralized thermal management system that includes many heat acceptors and a single absorption heat pump, which is generating refrigeration.

FIG. 2 shows another embodiment of the invention, specifically a centralized thermal management system 101 for generating refrigeration that includes a plurality of heat acceptors 102 (FIG. 2 shows 3 heat acceptors 102) and a single absorption heat pump 104, which is generating refrigeration. The centralized thermal management system 101 includes:

a plurality of heat acceptors 102, which remove heat from a plurality of warm temperature heat sources 103 at one or more temperatures;

an absorption heat pump 104, which uses the heat removed from the warm temperature heat sources 103 to generate refrigeration;

a generator pumped liquid loop 105, which transfers heat from the warm temperature heat sources 103 to the absorption heat pump 104 by using a generator pump 110 to pump a liquid first through the heat acceptors 102, where the liquid absorbs heat, and then through the generator 111 of the absorption heat pump 104, where the liquid releases heat;

an absorber pumped liquid loop 107, which transfers heat from the absorption heat pump 104 to a heat sink 106, such as a fresh water cooling loop on Navy ships, by using an absorber pump 112 to pump a liquid first through the absorber 113 of the absorption heat pump 104, where the liquid absorbs heat, then through the condenser 114 of the absorption heat pump 104, where the liquid absorbs additional heat, and then through the heat sink heat exchanger 115, where the liquid releases the heat to the heat sink 106); and an evaporator pumped liquid loop 108, which absorbs heat from a cooling load 109, and transfers the heat to the absorption heat pump 104 by using an evaporator pump 116 to pump a liquid first through the load heat exchanger 117, where the liquid absorbs heat from the cooling load 109, and then through the evaporator 118 of the absorption heat pump 104, where the liquid releases the heat to the evaporator 118.

Figure 3:
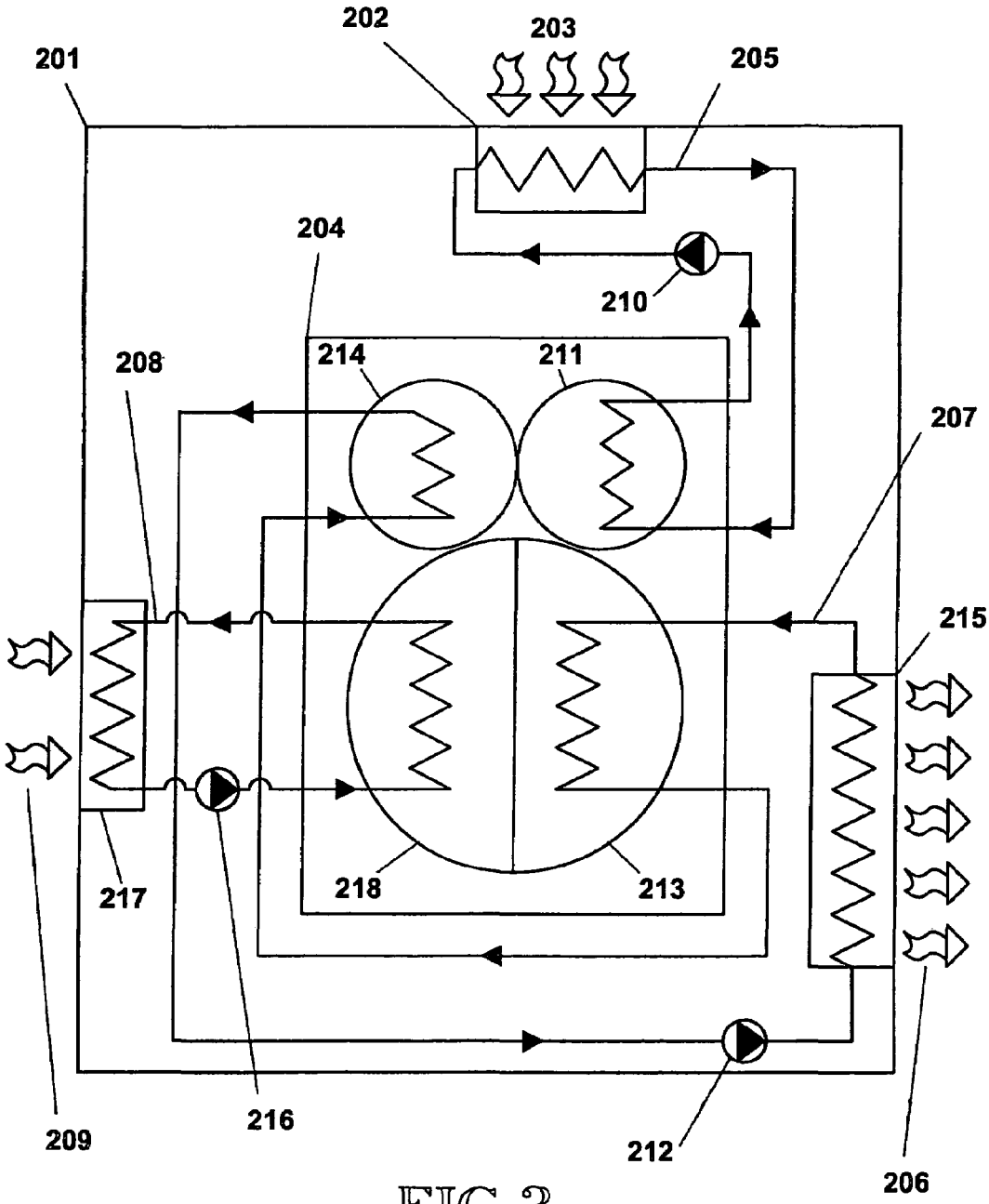
FIG. 3 shows one embodiment of the invention, a modular thermal management system that includes a single heat acceptor and a single absorption heat pump, which is generating heating.

For generating heating, FIG. 3 shows another embodiment of the invention, specifically, a modular thermal management system 201 that includes a single heat acceptor 202 and a single absorption heat pump 204, which is generating heating. One example of the type of heating the absorption heat pump 204 could be generating is heating a liquid, for example, water or an ethylene-glycol solution. The modular thermal management system generating heating 201 includes:

one heat acceptor 202, which removes heat from one warm temperature heat source 203;

one absorption heat pump 204, which uses the heat removed from the warm temperature heat source 203 to generate heating;

a generator pumped liquid loop 205, which transfers heat from the warm temperature heat sources 203 to the absorption heat pump 204 by using a generator pump 210 to pump a liquid first through heat acceptor 202, where the liquid absorbs heat, and then through the generator 211 of the absorption heat pump 204, where the liquid releases the heat;

an absorber pumped liquid loop 207, which transfers heat from the absorption heat pump 204 to a heating load 206 by using an absorber pump 212 to pump a liquid first through the absorber 213 of the absorption heat pump 204, where the liquid absorbs heat, then through the condenser 214 of the absorption heat pump 204, where the liquid absorbs additional heat, and then through the load heat exchanger 215, where the liquid releases the heat to the heating load 206; and an evaporator pumped liquid loop 208, which absorbs heat from a cool temperature heat source 209, and transfers the heat to the absorption heat pump 204 by using an evaporator pump 216 to pump a liquid first through the heat source heat exchanger 217, where the liquid absorbs heat from the cool temperature heat source 209), and then through the evaporator 218 of the absorption heat pump 204, where the liquid releases the heat to the evaporator 218).

Accordingly, a system has been described for thermal management, generating heating or cooling (refrigeration) depending on the system arrangement.

Although a preferred embodiment has been described for purposes of illustration, it should be understood that various changes or substitutions may be incorporated in such embodiment without departing from the spirit of the invention, which is defined by the claims which follow.

What is claimed is:

1. A thermal management system for generating refrigeration or heating, comprising:

one or more heat acceptors, which remove heat from one or more warm-temperature heat sources;

one or more absorption heat pumps which use heat removed from the warm-temperature heat sources to generate refrigeration or heating;

a transfer system for directing heat from the warm-temperature heat sources to the absorption heat pumps;

a transfer system for directing heat from the absorption heat pumps to one or more heat sinks if the absorption heat pumps are generating refrigeration;

a transfer system for directing heat from one or more cool-temperature heat sources to the absorption heat pumps if the absorption heat pumps are generating heating;

a transfer system for directing heat from one or more cooling loads to the absorption heat pumps if the absorption heat pumps are generating refrigeration; and a means for transferring heat from the absorption heat pumps to one or more heating loads if the absorption heat pumps are generating heating.

2. The thermal management system of claim 1, wherein the absorption heat pumps are at one or more temperatures.

3. The thermal management system of claim 1, wherein the cool temperature heat sources are at one or more temperatures.

4. The thermal management system of claim 1, including a single heat acceptor and a single absorption heat pump.

5. The thermal management system of claim 1, including a plurality of heat acceptors and a single absorption heat pump.

6. The thermal management system of claim 1, including a single heat acceptor and a plurality of absorption heat pumps.

7. The thermal management system of claim 1, in which the warm temperature heat sources are electronic circuits.

8. The thermal management system of claim 1, in which the means for transferring heat from the warm temperature heat sources to the absorption heat pumps is a pumped liquid loop.

9. The thermal management system of claim 1, in which the means for transferring heat from the absorption heat pumps to the heat sinks is a pumped liquid loop.

10. The thermal management system of claim 9, in which the liquid in the pumped liquid loop is salt water, fresh water, or a solution consisting of pure water and an additive.

11. The thermal management system of claim 1, in which the absorption heat pumps produce refrigeration for space cooling.

12. The thermal management system of claim 1, in which the absorption heat pumps produce refrigeration for chilling a liquid.

13. The thermal management system of claim 12, in which the liquid chilled by the absorption heat pumps is water.

14. The thermal management system of claim 1, in which the absorption heat pumps produce heating for space heating.

15. The thermal management system of claim 1, in which the absorption heat pumps produce heating for heating a liquid.

16. The thermal management system of claim 15, in which the liquid heated by the absorption heat pump is water.

17. The thermal management system of claim 1, in which the absorption heat pumps are capable of producing only refrigeration.

18. The thermal management system of claim 1, in which the absorption heat pumps are capable of producing only heating.

19. The thermal management system of claim 1, in which the absorption heat pumps are capable of producing both refrigeration and heating.

* * * * *